United States Patent [19]

Arnold

[11] 4,234,229

[45] Nov. 18, 1980

[54] SAFETY HARNESS FOR INFANTS

[76] Inventor: Jonathan H. Arnold, 609 5th St., Berthoud, Colo. 80513

[21] Appl. No.: 27,759

[22] Filed: Apr. 6, 1979

[51] Int. Cl.[3] ..... A47C 31/00

[52] U.S. Cl. ..... 297/467; 224/160; 297/465; 297/483

[58] Field of Search ..... 297/465, 467, 484, 483; 280/290, 801, 808; 182/3; 128/134, 133; 224/158, 159, 160

[56] References Cited

U.S. PATENT DOCUMENTS

| | | | |
|---|---|---|---|
| 3,099,486 | 7/1963 | Scott | 297/465 |
| 3,380,776 | 4/1968 | Dillender | 297/467 X |
| 4,037,764 | 7/1977 | Almosnino | 224/160 |
| 4,139,131 | 2/1979 | Hathaway | 224/160 |
| 4,141,368 | 2/1979 | Meyer | 128/138 X |
| 4,143,914 | 3/1979 | Klich | 224/160 |
| 4,149,687 | 4/1979 | Nunemacher | 224/159 |

FOREIGN PATENT DOCUMENTS

| | | | |
|---|---|---|---|
| 988475 | 5/1976 | Canada | 224/160 |
| 907687 | 10/1962 | United Kingdom | 224/160 |

*Primary Examiner*—James T. McCall
*Attorney, Agent, or Firm*—Edwin L. Spangler, Jr.

[57] ABSTRACT

This invention relates to a safety harness for use in combination with a lap belt as a means for holding an infant in face-to-face relation against the chest of an adult passenger in an airplane. The harness is characterized by an apron or bib-like fabric panel defining a pouch adapted to receive the back and rump of the infant. It carries a belt loop for detachably securing same to the lap belt together with inner and outer strap subassemblies. The inner of the two strap subassemblies releasably fastens the infant to the pouch while the outer one similarly releasably fastens the adult to both.

6 Claims, 5 Drawing Figures

SAFETY HARNESS FOR INFANTS

Adult passengers and children age two and older use the existing lap belts when seated in a commercial airplane. In aircraft, no provision whatsoever is made for the infant child other than to have an adult passenger hold the child. In the event that a crash or rough landing occurs, the safety of the child is dependent on how well the adult can hold onto the infant. An infant child deserves at least equal protection as other passengers.

The prior art is repleat with various and sundry types of lap belts, safety harnesses and other restraint devices whose purpose is to save an occupant of an automobile from serious injury in the event of a collision or serious accident; however, none is specifically designed for use in aircraft. Among these prior art patents are some in which a supplementary harness is used in conjunction with a lap belt. Examples of this type of arrangement are found in U.S. Pat. Nos. 3,819,197; 3,822,915; 3,834,758; 3,648,954; 3,561,817; 3,052,432; and, 3,380,776. Of the foregoing, only the Dillender, Soule and Klickstein et al patents specifically deal with the problem of safeguarding an infant or small child in a vehicle. In each instance, the child is harnessed independently of any adult passenger and is so oriented relative to the vehicle that he or she faces forwardly in the direction of normal movement.

U.S. Pat. No. 3,954,280 shows yet another infant harness where the child is secured to the vehicle independently of any other passenger facing forwardly. The harness in the Roberts patent differs, however, from those in the previously mentioned group in that it does not connect onto a lap belt or include the equivalent of one attached to the vehicle directly.

Several patents are known to exist wherein the infant is harnessed in face-to-face relation on the chest of an adult. Among these are the U.S. Pat. Nos. to Aukerman (3,481,517), Baldwin (4,079,467) and Hershman (3,229,873). While all of the foregoing patents teach some kind of a restraint to hold an infant against the body of an adult, none has anything to do with a vehicle or the safety belts contained therein. Other patents in a similar vane are the references of record in the Aukerman patent (supra).

For purposes of the present invention, probably the closest prior art is that of the Hershman patent which, if used by an adult passenger in a vehicle while seated and also restrained by a conventional lap belt, would approach the teaching found herein. Nevertheless, certain basic differences would still exist. First of all, the only direct connection of the infant harness is to the adult passenger with none being provided to the vehicle. Secondly, and even more important, there is no strap subassembly fastening the infant to the harness, but instead, only the harness to the adult with the infant in between. As such, the infant can escape the harness while it remains attached to the adult.

Accordingly, the present invention differs significantly from those mentioned above in that the harness is releasably fastened to the vehicle, to the infant and to the adult passenger carrying the infant. None of these references suggests such a combination.

Secondly, with the harness detached from the adult passenger, the infant remains attached to both the harness and to the vehicle through the lap belt. Upon detachment from the vehicle, the harness remains attached to the infant and can be attached to the adult in the manner of Hershman if so desired.

Finally, the harness holds the infant against the breast of the adult, where they are most comfortable and secure. Their needs can be attended to by merely disconnecting the strap subassembly attached to the adult's body which allows the baby to be laid in the lap face-up while still fastened to the harness and also the vehicle.

It is, therefore, the principal object of the present invention to provide a safety harness for infants for use in a commercial airplane in combination with the existing lap belts contained therein.

Another objective of the within described invention is to provide a harness for infant passengers that secures the infant to the harness, the harness to the vehicle and both the infant and the harness to the adult passenger.

An additional object of the invention herein disclosed and claimed is that of providing a safety harness that can be selectively connected and disconnected from both the vehicle and the adult's body to accommodate varying conditions and needs of the infant.

Further objects are to provide a safety harness that is in full compliance with applicable Federal Aviation Agency and other agency regulations defining performance and safety standards for seat belts in aircraft, while still being compact, lightweight, easy to use, fully adjustable, rugged, reliable, and versatile enough to accommodate the infant's needs.

Other objects will be in part apparent and in part pointed out specifically hereinafter in connection with the description of the drawings that follows, and in which.

Figure 1:
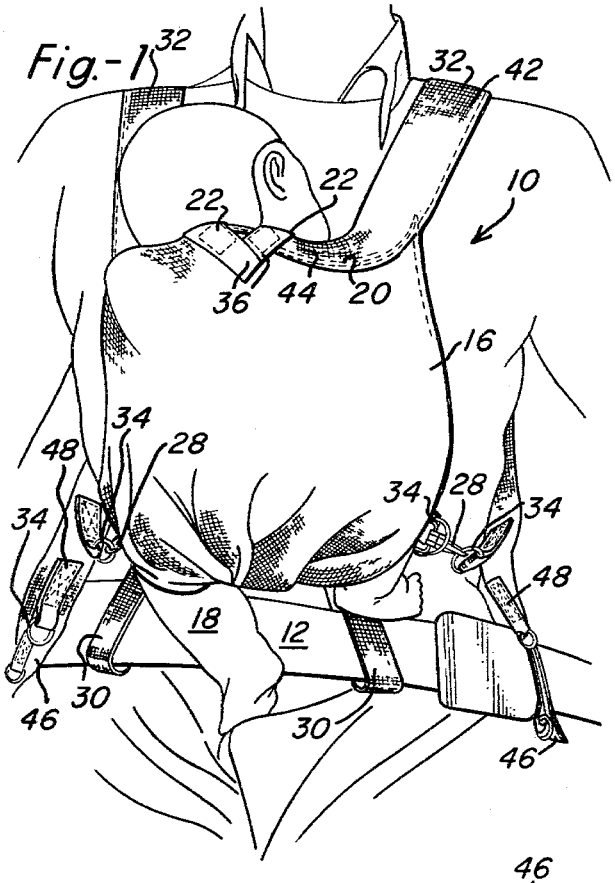
FIG. 1 is a front perspective view showing the infant strapped into the harness, the harness attached to the vehicle by means of the lap belt, and both the infant and harness strapped to the chest of an adult passenger.

Referring next to the drawings for a detailed description of the present invention, reference numeral 10 has been selected to broadly designate the harness while numeral 12 designates a conventional lap belt of the type used to strap an adult person 14 into a vehicle seat of an airplane (not shown). The central member of the harness assembly consists of a pouch-forming fabric panel 16. This panel consists of a bib or apron-like member adapted to cover the back and rump of an infant 18 seated in face-to-face relation in the adult's lap. As illustrated, this panel has an inverted generally trapezoidal shape capable of producing a pouch for the infant's body in the manner clearly shown in FIGS. 1 and 4. Other shapes could, of course, be substituted for the one shown, the only critical parameter being that of providing an adequate and effective restraining element capable of holding the infant in close to the adult's chest when properly secured thereto in the manner about to be described. In the particular form illustrated, for instance, panel 16 has its upper edge 20 terminating at approximately the infant's neckline so as to not interfere with movement of its head.

Figure 3:
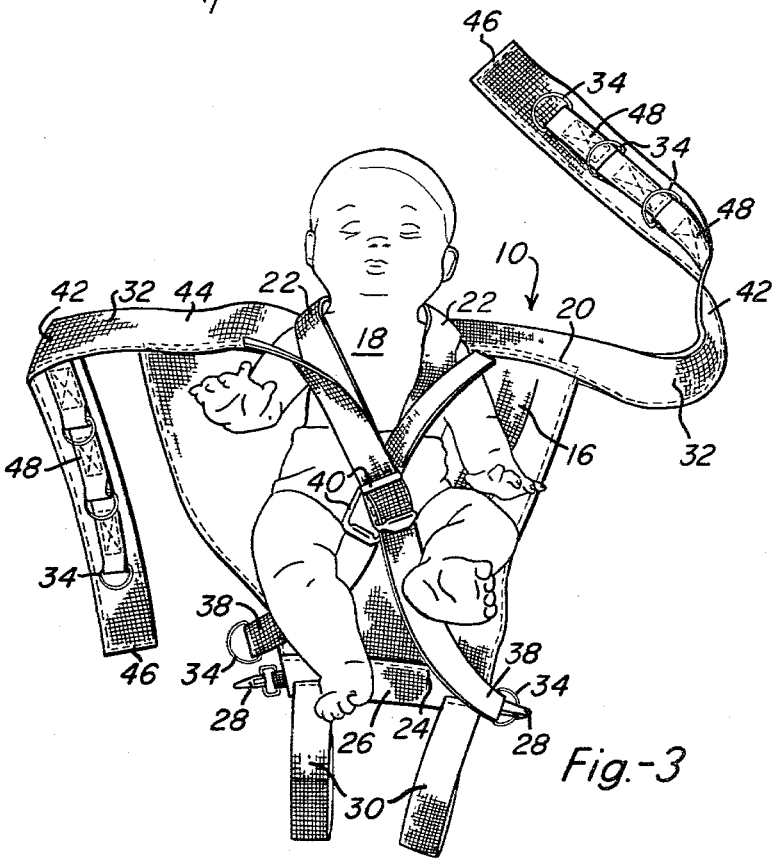
FIG. 3 is a perspective view looking at the infant as seen from the viewpoint of the adult passenger, the lap belt loop and adult strap subassembly having been disconnected to better reveal the child's strap subassembly and the manner in which it is used to fasten his or her body securely within the pouch-forming fabric panel at the back.

In FIG. 3, it can be seen that the bottom edge 24 of the panel has a horizontally-disposed length of woven belting 26 sewn thereto with snap fasteners 28 secured at opposite ends. At least one, and preferably, a pair of horizontally-spaced looped straps 30 hang down from belt 26 to which they are sewn as indicated.

Figure 4:
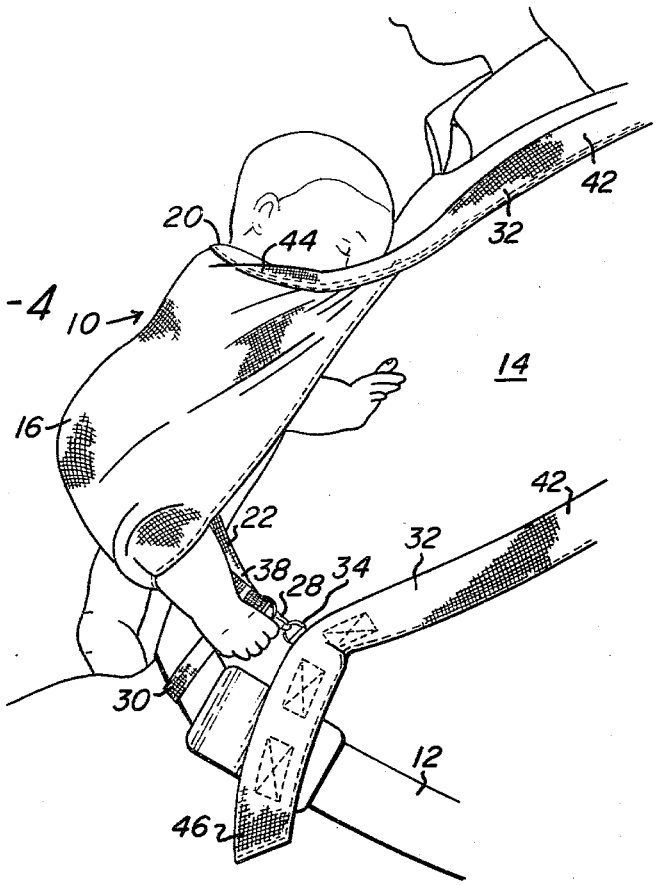
FIG. 4 is a side perspective view showing the assembly of FIG. 1 from a position to the right side of the adult passenger; and, FIG. 5 is a side perspective similar to FIG. 4 but showing the adult bent over the infant in the so-called "crash position."

In FIGS. 1 and 4, it can be seen that these loops 30 receive the lap belt 21 and cooperate therewith to releasably fasten the lower edge of the pouch-forming panel 16 to the aircraft or other vehicle in which it is located. The infant's chest straps 22 as well as the adult's shoulder straps 32, all of which will be described in detail presently, have their free ends detachably connected to one or the other of these snap fasteners 28. Other types of quick-disconnect connectors can, of course, be substituted for the snap fasteners 28 without departing from the basic teaching found herein; however, not withstanding this fact, there are certain advantages present in a snap fastener that render it ideally suited for use in this particular application, namely, its capability of accepting more than one D-ring 34.

Next, with specific reference to FIGS. 1 and 3, it will be seen that the fixed ends 36 of the infant's chest straps 22 are both fastened to the upper margin 20 of the panel 16 at a point behind his or her neck (see FIG. 1). From this point these chest straps diverge and pass around the neck and over both shoulders onto the chest as seen in FIG. 3. On the chest, the straps are crossed over one another, then passed down between the legs and out underneath them to where the D-rings on their free ends 38 connect to fasteners 28. In the particular version illustrated, both straps 22 are of the two-section type having a buckle 40 adjustably connecting the two sections together so that the length thereof can be adjusted to suit different size infants. The resulting infant harness subassembly cooperates with the pouch-forming panel 16 and the lap belt 12 to securely fasten the infant to the latter.

The primary function of this subassembly is to keep the infant from being thrown out the top of the pouch between the adult's shoulder straps 32 of the adult harness subassembly. While the adult's shoulder straps pass over both the infant's and adult's shoulders in the manner best seen in FIGS. 1 and 4 and, in so doing, will probably be effective by themselves to keep the infant in the pouch, the infant's chest straps add an additional measure of protection in this regard.

Looking next at the first four figures of the drawings, it can be seen that the adult's shoulder straps 32 consist, in the form shown, of opposite end sections 42 of a single length of web belting having its center section 44 sewn across the top margin 20 of the pouch-forming panel 16. Instead of using two-part buckle-connected straps like the infant's chest straps 22, the adult's shoulder straps preferably provide a spaced series of two or more D-rings located different distances from the free ends 46. Each D-ring is sewn to the belt end section in the usual way using short lengths of fabric 48 as shown.

Figure 2:
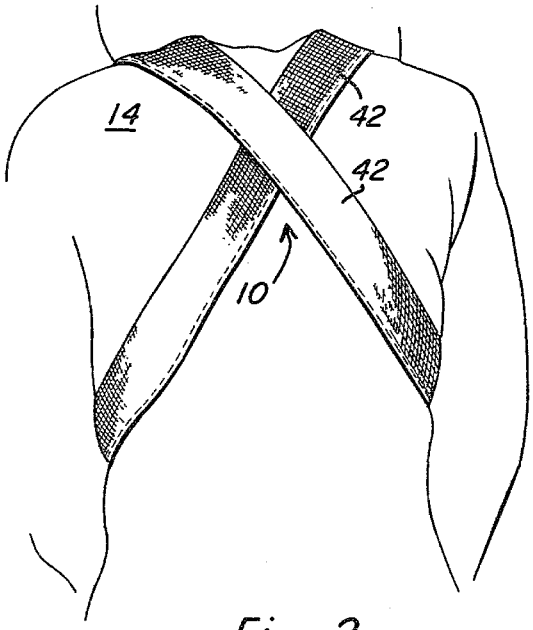
FIG. 2 is a rear perspective showing the manner in which the shoulder straps of the adult strap subassembly cross on the back of the adult.

As seen in FIGS. 2 and 4, the adult's shoulder straps pass over both the infant's shoulders and those of the adult, then down onto the back of the latter where they cross before being passed forwardly again under the arm where they are finally releasably fastened to strap fasteners 28. This adult harness subassembly has as its main purpose that of holding the infant securely against the chest of the adult as clearly revealed in FIGS. 1 and 4. While in an airplane on the ground and at times other than during take-off and landing, it may be desirable to leave the infant in the pouch and the pouch connected to the lap belt but with the shoulder straps loose. In such a condition, the child can be laid on his back in the adult's lap while the adult remains seated upright. It then becomes a simple matter to refasten the adult's shoulder straps whenever the "fasten seat belt" sign comes on, rough weather is encountered or some other condition exists calling for the exercise of the full protection afforded by the harness.

Figure 5:
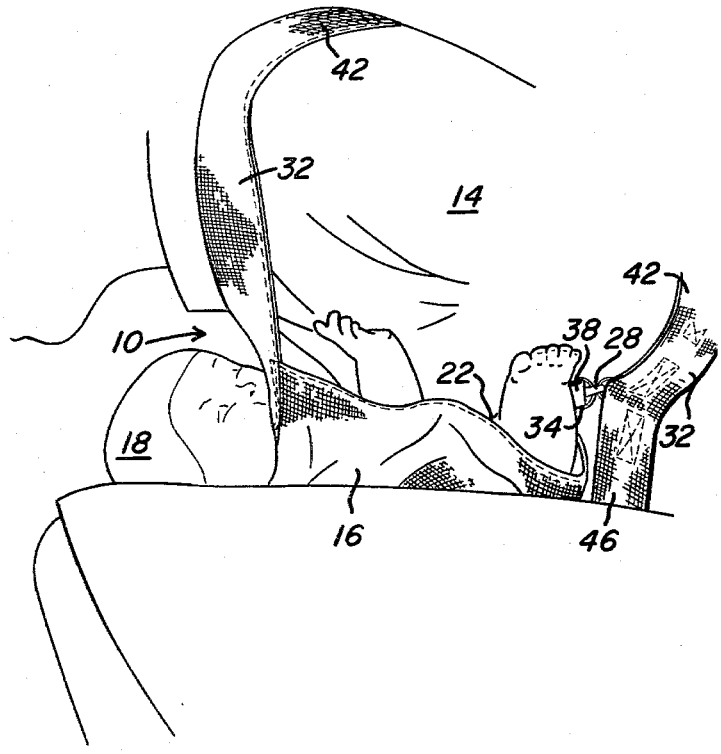

Finally, in FIG. 5 it will be seen that the harness of the present invention is fully compatible with the recommended "crash position" which is to be assumed by passengers in commercial airliners and the like in the event of an emergency. As the adult bends over, the infant is merely laid down in the adult's lap in which position the child is shielded both above and below by the adult's body. In all positions where the infant is held by the harness, he or she faces the adult which is a secure and natural one for any small child. The restrained position of FIGS. 1 and 4 is essentially identical to that which the child assumes when being carried cradled in the adult's arms.

What is claimed is:

1. The two party harness for use in combination with a lap belt to hold an infant in face-to-face relation against the chest of a seated adult which comprises: a fabric panel of a size and shape effective to cover the back and rump of an infant child, belt-receiving means depending from said panel for detachably connecting same to a lap belt, a first strap subassembly carried by said panel effective to detachably fasten the latter to the infant's back, and a second strap subassembly carried by said panel for detachably securing same in slack relation to the chest of an adult, said belt-receiving means and first strap subassembly cooperating to detachably secure the infant to the lap belt, and said second strap subassembly being effective to harness an infant thus secured to the chest of an adult held in seated position by said lap belt.

2. The infant harness as set forth in claim 1 wherein the first strap subassembly includes means permanently attached to an upper portion of said panel and defining a pair of chest straps with free ends detachably connectable to said panel at points along opposite sides thereof, said straps being so located and arranged relative to one another and to said panel such that they can be passed over the infant's shoulders and down the front of the body before being returned to said points of attachment through the crotch.

3. The infant harness as set forth in claim 1 wherein the second strap subassembly includes means permanently attached to an upper portion of said panel and defining a pair of shoulder straps with free ends detachably connectable to said panel at points along opposite sides thereof, said straps being so located and arranged relative to one another and to said panel such that they can be passed over the adult's shoulders and down the back of the body before being returned to said points of attachment under the arms.

4. The infant harness as set forth in claim 2 wherein said chest straps are of a length selected to cross over one another on the infant's chest.

5. The infant harness as set forth in claim 3 wherein said shoulder straps are of a length selected to cross over one another on the adult's back.

6. The infant harness as set forth in claim 3 wherein said first strap subassembly includes a pair of chest straps having one end thereof permanently attached to the fabric panel and the ends opposite said one end detachably connected to said points on opposite sides of said panel where said shoulder straps are connected.

* * * * *